US005534124A

United States Patent [19]

Rundhaug

[11] Patent Number: 5,534,124

[45] Date of Patent: Jul. 9, 1996

[54] ON-SITE ELECTROCHEMICAL DEHALOGENATION PROCESS AND SYSTEM

[75] Inventor: Patrick A. Rundhaug, Tucson, Ariz.

[73] Assignee: Chem-Pro, Tucson, Ariz.

[21] Appl. No.: 530,068

[22] Filed: Sep. 19, 1995

[51] Int. Cl.[6] ..... C25F 5/00

[52] U.S. Cl. ..... 588/204; 205/413; 205/688; 205/695; 205/696

[58] Field of Search ..... 205/688, 695, 205/696; 204/450, 513, 271

[56] References Cited

U.S. PATENT DOCUMENTS

| | | | |
|---|---|---|---|
| 5,093,011 | 3/1992 | Friedman et al. | 210/751 |
| 5,095,144 | 3/1992 | Sato et al. | 562/481 |
| 5,096,600 | 3/1992 | Hoch | 210/751 |
| 5,102,510 | 4/1992 | Darian | 204/59 R |
| 5,132,006 | 7/1992 | Neumann et al. | 208/262.1 |
| 5,141,629 | 8/1992 | Pir-Bar et al. | 208/262.1 |
| 5,174,893 | 12/1992 | Halpern et al. | 208/262.5 |
| 5,185,488 | 2/1993 | Hawari et al. | 585/469 |
| 5,191,118 | 3/1993 | Corriea et al. | 562/604 |

FOREIGN PATENT DOCUMENTS

WO89/05172 12/1988 WIPO .

*Primary Examiner*—John Niebling

*Assistant Examiner*—Brendan Mee

*Attorney, Agent, or Firm*—Victor Flores

[57] ABSTRACT

An electrochemical process and system for dehalogenating halogenated hydrocarbons. The process facilitates on-site processing and transformation of waste oils, PCB oils in electrical transformers and chlorinated solvents to salts. The system includes a two-piece tubular structure including an electrical insulating member, an electrode member having perforations leading into a hollow vessel portion. The process includes, by example, reacting the halogenated hydrocarbon compound with at least one metal hydroxide selected from a metallic hydroxide group consisting of sodium hydroxide, calcium hydroxide, zinc hydroxide, and potassium hydroxide in the presence of an alcohol selected from an alcohol group consisting of methanol, ethanol, or isopropanol. The tubular structure is inserted into the container and energized by applying a voltage to the electrode member. The electrochemical reaction results in producing an electrolyte salt solution containing metallic cations and halogen anions which migrate into the hollow vessel portion where the migrated halogen ions are trapped. Upon completion of the reaction, the probe with the trapped halogen is removed from the container and the trapped halogen disposed. The process is repeated until the concentration level of halogen is at, or below, a predetermined acceptable concentrations level. The process has particular utility for on-site treatment of hazardous waste material in 55 gallon drums and facilitates recycling of existing stored hazardous material.

7 Claims, 5 Drawing Sheets

TCE

PCE

Chlorobenzene

HH

ON-SITE ELECTROCHEMICAL DEHALOGENATION PROCESS AND SYSTEM

FIELD OF THE INVENTION

The present invention relates to system and processes for dehalogenating halogenated organic compounds. More particularly, the present invention relates to systems and processes for electrochemically dehalogenating halogenated organic compounds. Even more particularly, the present invention relates to on-site, field implemented processes and systems for electrochemically dehalogenating halogenated organic compounds, such as polychlorinated biphenyls (PCBs), and/or chlorinated solvents contained in barrels of disposed hazardous liquids, or in electrical transformer's chassis.

DESCRIPTION OF THE PRIOR ART

Industry has found halogenated organic compounds, such as PCBs, very useful in electrical applications, such as in capacitors, electrical insulators and transformers. The usefulness is attributed to the PCB's thermal stability, and resistance to oxidation and high insulating properties. Other industrial applications include using halogenated solvents, typically chlorinated solvents, as degreasers for metals, resin fluxs, automotive degreasing, and motor oil with the halogenated solvents. However, recent environmental concerns for their potential toxic properties has led to the termination of PCB production and government regulated disposal measures. Disposal measures have resulted, to a large extent, in storage of the halogenated organic compounds rather than to decompose the halogenated organic compound. Storage is easier since decomposing involves breaking the highly stable carbon-halogen covalent bond, a physical process typically involving high temperature incineration, see generally U.S. Pat. No. 5,174,893. Chemical processes for dehalogenating halogenated organic compounds are summarized in U.S. Pat. No. 5,174,893, which patent teaches a chemical process that utilizes lower temperature and/or smaller quantities of 2-methoxy-ethanol as a reagent. Other chemical process include U.S. Pat. Nos. 5,093,011, 5,095,144, 5,096,600, 5,132,006, 5,141,629, 5,185,488 and 5,191,118. Alternative methods of dehalogenation include dehalogenation by electrochemical techniques. U.S. Pat. No. 5,102,510 summarizes prior art electrochemical dehalogenation processes and teaches an electrochemical dehalogenation process wherein a halogenated organic compound(s) is(are) combined with a solvent, an electroconductive salt and an electron transfer compound and then exposed to a voltage to remove halogens from the halogenated organic compounds. The process requires the use of electron transfer compounds, such as polynuclear aromatic organic compounds, which help compensate for using low concentrations of the electroconductive salt. The '510 patent, and other electrochemical dehalogenation process patents, teach using a conventional electrochemical cell containing oppositely charged electrodes (anode and cathodes) placed alternately within the electrolyte in the system to complete the cell circuitry for operation of the cell. Further, the prior art electrochemical dehalogenation processes require distillation facilities to recover the solvents, salts, products and by-products which are formed during the electrochemical reactions.

Traditional anode and cathode elements taught by the prior art electrochemical cells are seen as a constraint for on-site, or field applications. Further, the need for special facilities to conduct the prior art electrochemical processes is also seen as a constraint for on-site, or field applications. A need is also seen to minimize the chemical complexity of the reagents used for producing the electrolyte solution containing the ionized halogens. To this end, the prior art electrochemical dehalogenation processes have not utilized metallic hydroxides and alcohol in an electrochemical cell to effect dehalogenation.

Therefore an object of the present invention is to provide an on-site, non-complex, electrochemical process useful in dehalogenating halogenated organic compounds in containers containing the contaminated material.

Another object of the present invention is to provide an electrode/probe apparatus useful in facilitating an on-site electrochemical process for dehalogenating halogenated organic compounds in containers containing the contaminated material.

SUMMARY OF THE INVENTION

Accordingly, the foregoing objects are accomplished by providing an on-site electrochemical process useful in dehalogenating contained halogenated organic compounds material, referred to herein also as halogenated hydrocarbon compounds. The electrochemical process of the present invention comprising: (a) providing waste material in a container forming an electrochemical cell, the waste material comprising a halogenated hydrocarbon compound; (b) providing a probe structure, the probe structure being a rigid, elongated, hollow, multi-piece tubular structure including an electrical insulating member, an electrode member and a hollow vessel portion; (c) providing an electrical energy source for energizing the electrode member; (d) determining that the halogenated hydrocarbon compound exceeds a predetermined toxic level of concentration; (e) admixing to the contained halogenated hydrocarbon compound a predetermined amount of at least one metal hydroxide selected from a metallic hydroxide group consisting of sodium hydroxide, calcium hydroxide, zinc hydroxide, and potassium hydroxide; (f) further admixing an alcohol into the halogenated hydrocarbon compound/metal hydroxide mixture, the alcohol being selected from an alcohol group consisting of methanol, ethanol, or isopropanol; (g) inserting the probe structure into the container; (h) applying a voltage to the electrode member from the electrical energy source; (i) producing an electrolyte salt solution containing metallic cations and halogen anions; (j) migrating the halogen anions towards the electrode member and into the hollow vessel portion of the probe structure; (k) trapping the migrated halogen ions in the hollow vessel portion; (l) stopping application of voltage and removing the probe structure containing trapped halogen from the container and disposing of the trapped halogen; and (m) repeating steps (d) through (l) as required until the concentration level of halogen in the halogenated hydrocarbon compound is at, or below, a predetermined acceptable concentration level.

The preferred embodiment is an electrochemical cell that includes a metal container that facilitates usage of the probe structure having a capped, insulated, outer tubular member and a metal inner tubular electrode member. The outer tubular member and the metal inner tubular electrode member are provided with a plurality of holes to allow the migration of the halogen ions into the volume defined by the inner tubular electrode member. The outer tubular member and the metal inner tubular electrode member pivot with respect to each other to facilitate an open or closed state for allowing the migration to occur, and for trapping the halogens in the confines of the inner tubular electrode member.

In step (e) above, the metallic hydroxides may optionally be admixed with at least one predetermined metal, selected from the metal group at large which includes, but not limited to, metals such as sodium, calcium, zinc and potassium. The introduction of the predetermined at least one metal in some particular halogenated carbon compounds is to assure that an ample source of positive charged metal ions are available for combining with the halogen anions to form a salt in solution, i.e. this facilitates the halogen in some halogenated hydrocarbons to combine with a free metal rather than to go through a substitution reaction. Pretesting the contaminated material will help make the determination.

While the process of the present invention can be employed to dehalogenate oils containing PCB's (polychlorinated biphenyls) that are physically in a metal transformer chassis, or in metal barrels or drums, the process can readily be employed to dehalogenate other halogenated hydrocarbon such as TCE, PCE, methylene chloride, freon, trihalomethanes, trihalomethanes in waste water, PCA, or any other halogenated hydrocarbon which is regulated by environmental regulation because of health hazards, and which may be stored or contained in a non-metal container, including halogen gases in vapors, and halogenated hydrocarbon in solids (e.g. fatty acids & lipids).

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE INVENTION AND DRAWINGS

Figure 1:
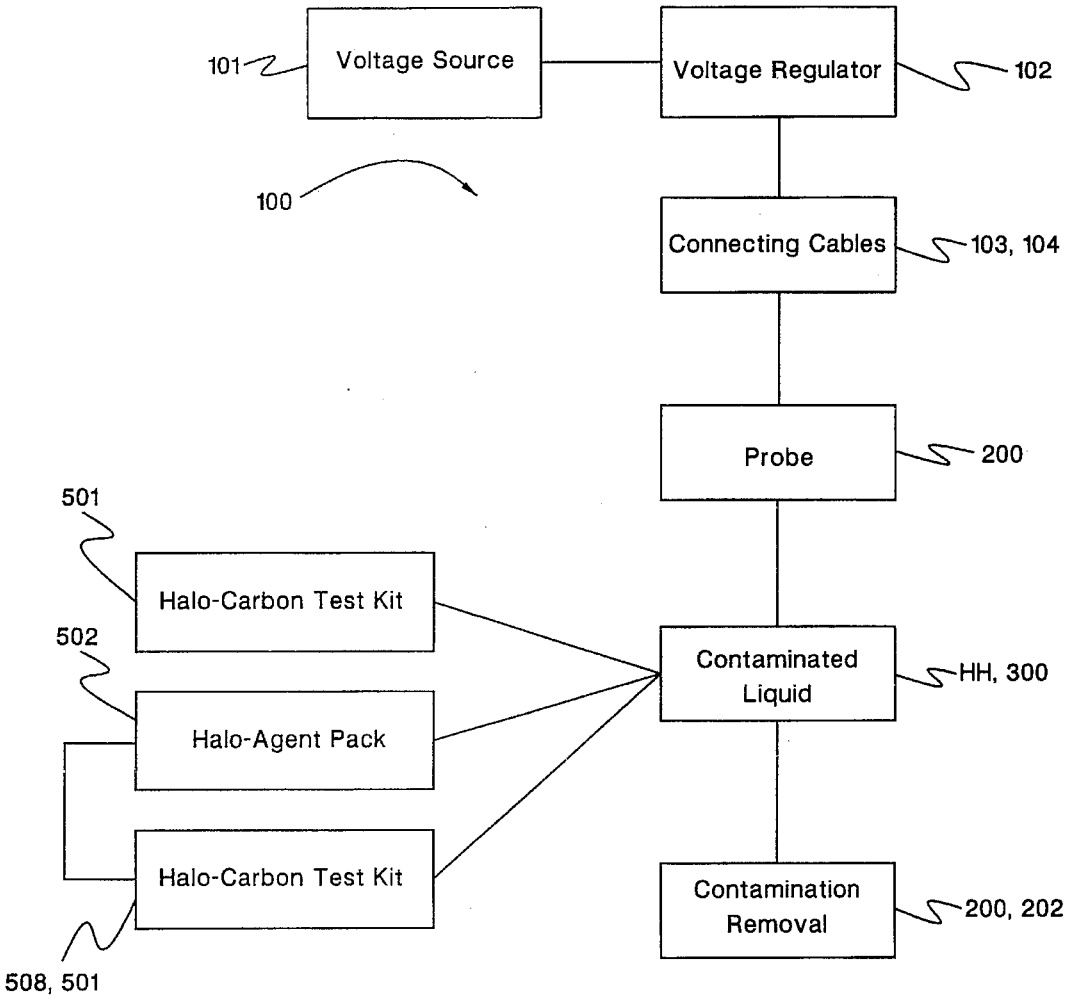
FIG. 1 is a block diagram representation of an initial set-up of the electrochemical dehalogenation process of the present invention.
Figure 2:
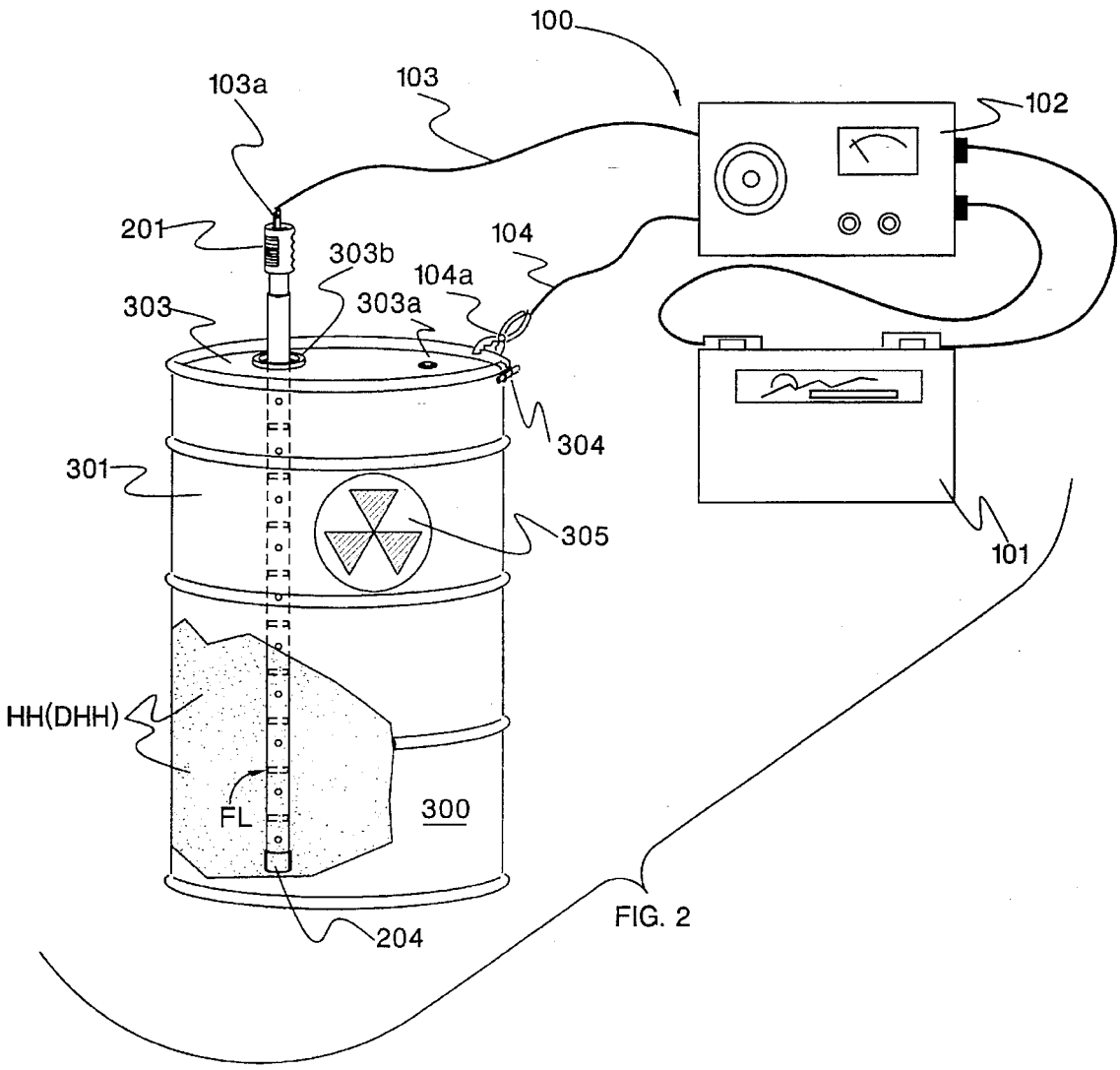
FIG. 2 is a mechanical arrangement of the equipment employed at a field site to dehalogenate barrels of contaminated halogenated material.

The process of the present invention is facilitated by the equipment and chemical elements depicted in FIG. 1 and FIG. 2. FIG. 1 shows system 100 preferably including an energy source such as a power converter, or a portable battery voltage source 101 regulated by voltage regulator 102 that is electrically coupled via cables 103, 104 to a multi-purpose probe 200. The energy source is preferably variable for delivering a voltage between 0–120 volts. However, an automotive 12 volt battery may be employed after having determined that a 12 volt cell voltage will be adequate for breaking down the particular halogenated hydrocarbons involved. A 12 volt cell voltage has been successful in breaking down PCB's. Probe 200 functions as a mixing tool, as an electrode, and as a vessel for trapping the decomposed halogen anions. Probe 200 is inserted into a container 300 containing the halogenated hydrocarbon material HH. FIG. 1 also shows the operative step 501 depicting acting on the contained material HH and involves the initial testing of the contaminated material for determining the concentration of the contained halogen, the subsequent re-testing step 501, as required, and a reagent treatment step 502 involving use of the reagents required for the electrochemical process of the invention. A titration type test kit, commercially available under the tradename DEXSIL, has proven accurate in determining compliance with an acceptable concentration level of 1000 ppm, or less. The electrochemical process concludes after each reaction with removal of trapped halogen that has migrated to the probe/electrode tubing 200,202.

Graphically, FIG. 2 illustrates the system 100 including an energy source, by example a battery 101, a voltages regulator 102 electrically connected to probe 200 via lead 103 and connection 103*a*, and being electrically grounded to barrel frame 301 via lead 104 and connection 104*a*. Probe 200, described in more detail below, includes an insulated handle 201 and an insulating detachable cap 204. As depicted, a typical hazardous waste container 300 containing hazardous waste material, such as halogenated hydrocarbons HH, is marked with an industry recognized symbol 305, and sealed with a seal 304. Container 300 includes, on lid 303, fill and vent openings 303*a* and 303*b*. In accordance with the present invention, the halogenated hydrocarbon are decomposed and the halogen anions are trapped within probe 200, as depicted by flow action arrow FL, to render de-halogenated hydrocarbons DHH material in container 300. System 100 has particular utility in a field, or on-site setting, where 55 gallon drums, or other containers containing the hazardous waste are normally encounter. No longer will the waste material recyclers be limited to recycling non-hazardous material. The present invention facilitates on-site testing the concentration of halogens in the waste material and on-site processing and transforming PCBs and chlorinated solvents to salts.

Figure 3:
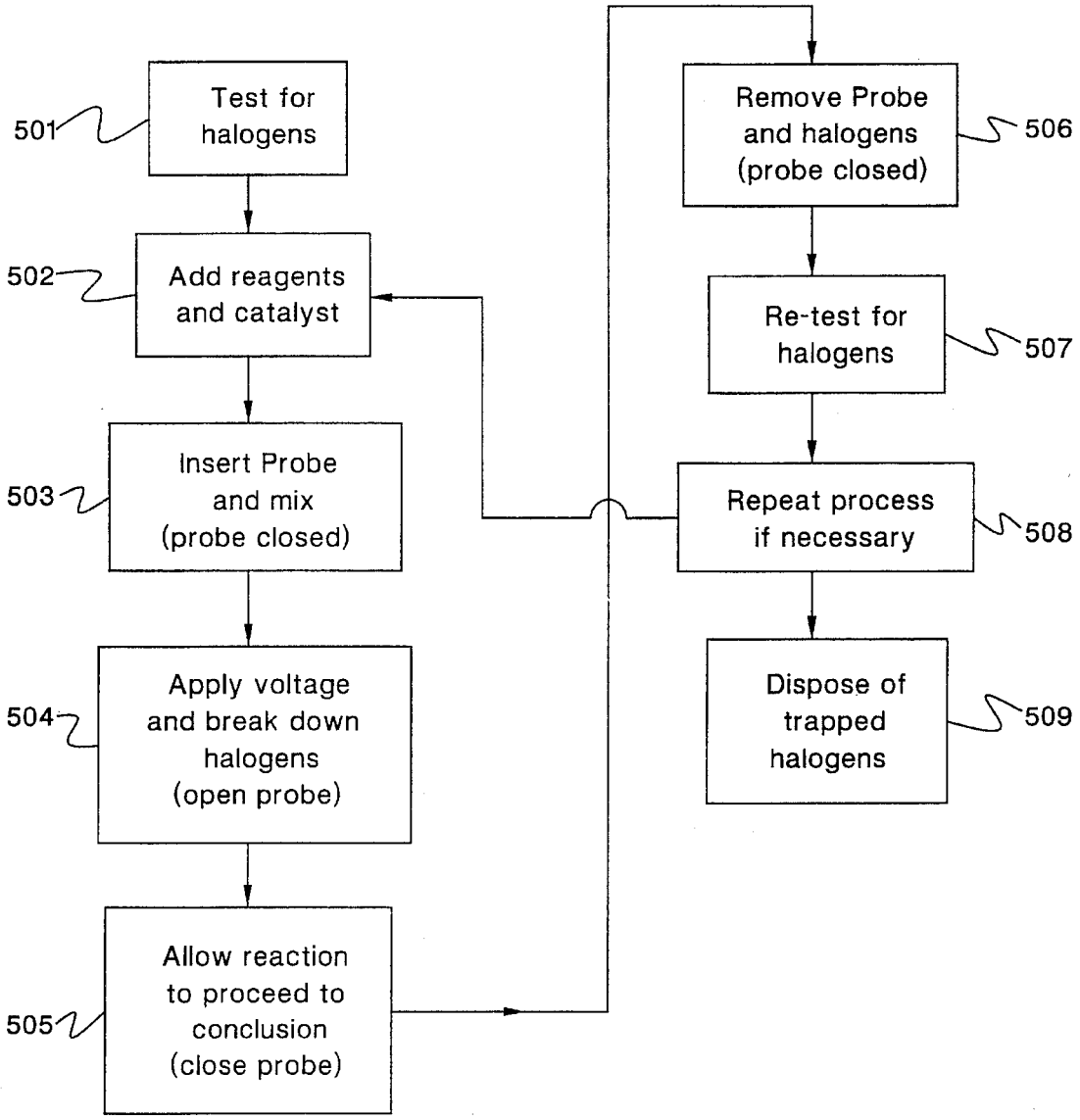
FIG. 3 is a block diagram representation of the electrochemical dehalogenation process of the present invention.
Figure 4A:
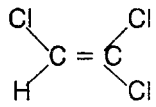
FIGS. 4*a*, 4*b*, 4*c*, and 4*d*, respectively, show exemplary chemical models of a group of halogenated material, namely TCE, PCE, Chlorobenzene, and a generalized halogenated hydrocarbon (HH) model which can be dehalogenated by the process of the present invention.
Figure 4B:
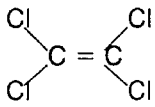
Figure 4C:
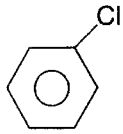
Figure 4D:
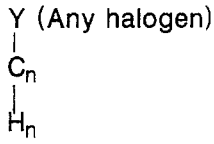
Figure 5A:
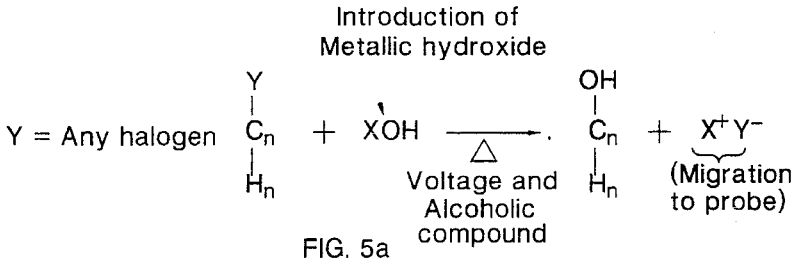
FIG. 5*a* shows a generalized dehalogenation reaction in accordance with the present invention.
Figure 6:
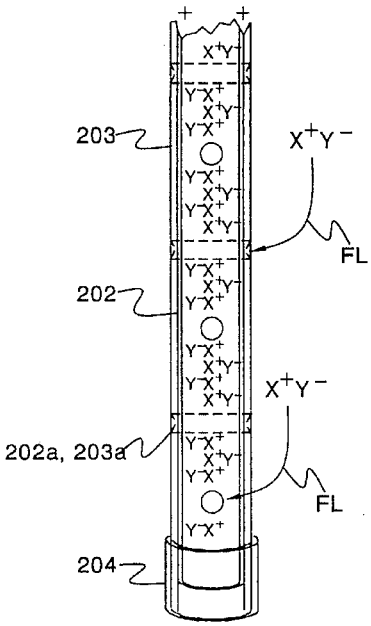
FIG. 6 shows the result of the migration of the halogen anions towards the positively charged electrode member of the probe, and showing in particular the chemical structure of the solution that is trapped in the probe.
Figure 7:
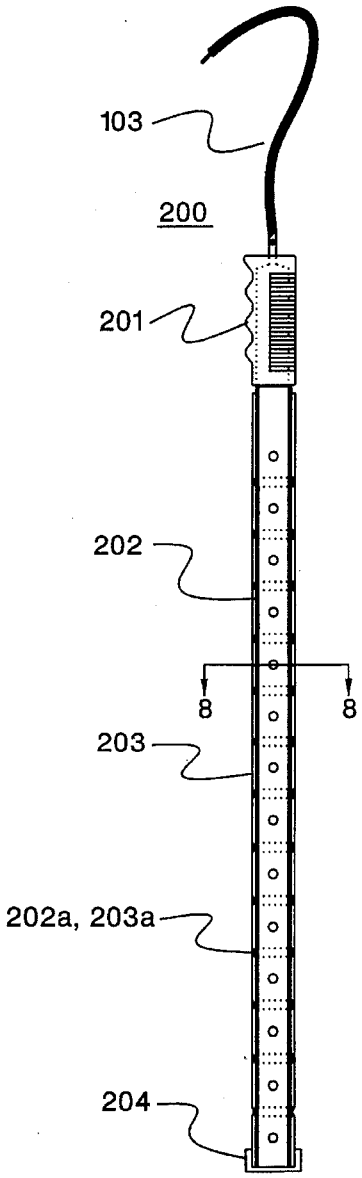
FIG. 7 is a perspective view of the vessel/electrode probe employed in the process of the present invention, showing in particular the plurality of perforations that facilitate migration of the halogen anions into the hollow metal tubing that functions as a positive electrode member of the probe.

FIG. 3 shows a block diagram representation of the electrochemical dehalogenation process of the present invention. The process includes an initial testing step 501 to determine the concentration level of the halogens (a concentration level greater than 1000 part per million ppm has been determined as being toxic and hazardous), a reagent adding step 502, an inserting probe step 503, (which step 503 may include utilizing the probe 200 for mixing the reagents in barrel 300), an initial energization and halogen break-down/migration step 504, a completion of reaction/halogen trapping step 505, a de-energization/probe removal step 506, a re-testing of halogen concentration step 507, a repeating of process decision step 508 and a disposal of trapped halogen step 509. Stated in non-block diagram terms, the electrochemical process for dehalogenating halogenated hydrocarbon compounds comprises the steps of:

(a) providing waste material contained in a container 300, said waste material comprising a halogenated hydrocarbon compound HH, see generally chemical models in FIGS. 4*a*, 4*b*, 4*c* and 4*c* showing the chemical structure for trichloro-ethylene TCE (FIG. 4*a*), perchloro-ethylene PCE (FIG. 4*b*), Chlorobenzene (FIG. 4*c*) and a generalized halogenated hydrocarbon chemical structure HH (FIG. 4*d*) which would include polychlorinated-biphenyls PCBs;

(b) providing a probe structure 200, said probe structure comprising a rigid, elongated, hollow, multi-piece tubular structure including an electrical insulating member 203, an electrode member 202 forming a hollow vessel portion, see generally FIGS. 6 and 7;

(c) providing an electrical energy source 101,102 for energizing said electrode member 202, (preferred cell voltage being variable between 0–120 volts);

(d) determining that said halogenated hydrocarbon compound HH exceeds a predetermined toxic level of concentration, by example 1000 ppm;

(e) admixing to said contained halogenated hydrocarbon compound HH a predetermined amount of at least one metal hydroxide XOH selected from a metallic hydroxide group consisting of sodium hydroxide, calcium hydroxide, and potassium hydroxide, see FIG. 5*a;*

(f) further admixing an alcohol into the halogenated hydrocarbon compound/metal hydroxide mixture, said alcohol being selected from an alcohol group consisting of methanol, ethanol, or isopropanol and comprising at least 0.25% by volume of the total solution and acting as a catalyst in the reaction, see generally FIG. 5*a;*

(g) inserting said probe structure 200 into said container 300, probe 200 may be used for mixing the added reagent material;

(h) applying a voltage to said electrode member from said electrical energy source, applied voltage being predetermined according to the halogenated hydrocarbon compound to be halogenated and reagents used, 8–14 volts being adequate to breakdown PCBs, see FIG. 5*a;*

Figure 8:
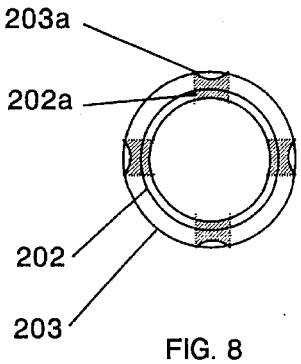
FIG. 8 is a cross section taken along line 8—8 in FIG. 7 showing the alignment of the perforations in each of the tubular members of the probe.
Figure 8A:
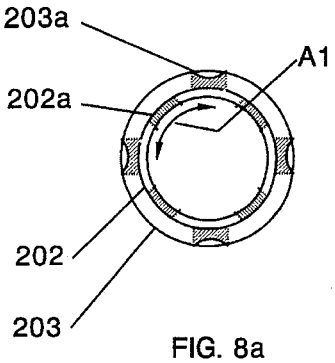
FIG. 8*a* is a section view of the multi-purpose probe illustrating the rotating action of the inner electrode member that opens or closes the perforations to either allow migration of the halogen anions, or facilitate trapping the halogen anions for subsequent disposal.

(i) producing an electrolyte salt solution containing metallic cations and halogen anions ($X^+Y^-$);

(j) migrating halogen anions in dissolved salt form ($X^+Y^-$) towards said electrode member and into said hollow vessel portion of said probe structure, see FIGS. 5*a*, 6 and 8 depicted by flow action arrow FL and aligned holes 202*a*, 203*a*, reaction times, reaction times of at least 10 minutes is recommended;

(k) trapping said migrated halogen ions in dissolved salt form ($X^+Y^-$) in said hollow vessel portion, see FIG. 6 and FIG. 8*a* depicting rotation arrow A1 and non-aligned/closed holes 202*a*, 203*a;*

(l) stopping application of voltage and removing said probe structure 200 containing trapped halogen ($Y^-$) from said container and disposing of said trapped halogen;

(m) repeating steps (d) through (l) as required until the concentration levels of halogen in the de-halogenated hydrocarbon compound DHH is at, or below, a predetermined acceptable concentrations level, by example 1000 ppm. The de-halogenated hydrocarbon compound DHH are non-hazardous and may be disposed of according to recycling industry practices.

Figure 5B:
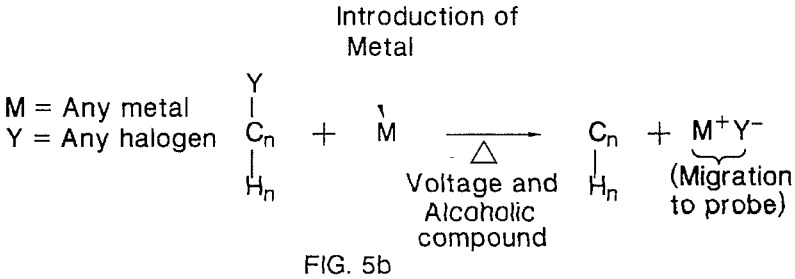
FIG. 5*b* shows a generalized dehalogenation reaction in accordance with the present invention wherein a metal, in non-compound form, is added as a reagent.

FIG. 5*b* shows the electrochemical process where, alternatively, the reaction is conducted by admixing at least one metal M consisting of zinc, sodium, calcium and potassium, to assure an ample source of positively charged metal ions $M^+$ for combining with said halogen anions $Y^-$ to form an electrolyte salt in solution $M^+Y^-$. The metal M may be mixed with the metal hydroxides XOH in amounts of at least 0.5% by weight of the reagent solution.

FIG. 7 shows vessel/electrode probe 200 employed in the process of the present invention, wherein, of particular utility is the concentric tubular design including insulating tube member 203 and electrode/cathode member 202 and the plurality of perforations 202*a*, 203*a* that facilitate migration of the halogen anions $Y^-$ into the hollow metal tubing 202 that functions as a positive electrode member of the probe. Electrode 202 is preferably constructed from commercially available copper tubing, while insulating tubing 203 and cap 204 are constructed from preferably commercially available pvc tubing material. Electrode 202, constructed from copper tubing having a length of four (4) feet, and a one (1) inch diameter has proven effective to support the de-halogenation of PCB compounds. Other highly conductive metal electrode materials that resist degradation during the particular electrochemical reaction being performed may also be employed. A close-fitting concentric design relationship (by example: 0.005 inch spacing) between tubing 202 and 203 is essential to obtain a closed state upon trapping the migrated halogen ions in dissolved salt form ($X^+Y^-$) into the hollow vessel portion of electrode 202, yet facilitate rotation action A1. Perforation holes 202*a*, 203*a*, having a diameter of at least one-quarter (¼) inch, have proven effective to facilitate the migration of the halogen ions in dissolved salt form ($X^+Y^-$). Also, a threaded detachable cap 204 has proven effective for disposing of the trapped waste material.

The electrochemical process of the present invention is further illustrated by the following examples, which examples are illustrative and are not intended to limit the scope of the invention as disclosed and claimed herein.

EXAMPLE 1

An electrochemical cell including a 50 gallon metal transformer chassis containing waste oil contaminated with PCB was processed in accordance with the present invention. Samples of the PCB contaminated material were tested and determined to be 1500 ppm, requiring proper disposal procedures. A variable voltage source was provided and properly connected to the metal frame of the chassis and to an end of electrode member 202. Reagent material provided in packets of dry chemicals, namely a dry chemical mixture consisting of (378 grams of calcium) and (378) grams of sodium hydroxide) and a packet of liquid chemical, namely (350) ml of ethyl alcohol) were added and mixed with the PCB contents of the 50 gallon chassis. A probe 200, constructed as previously described, in a closed position (ref. FIG. 8*a*) was inserted into the chassis and utilized to further mix the solution. The voltage source was set to 12 volts and switched on to deliver the voltage to the electrode 202, probe 200 was then set to an open position (ref. FIG. 8) to allow migration of the chloride halogen. After 10 minutes of reaction time the voltage was turned off and the probe was again set to a closed position (ref. FIG. 8*a*). The probe containing the chloride halogen was removed from the barrel and the non-hazardous halogen contents discarded. The contents of the chassis were retested and the concentration level of halogens determined to be (200 ppm).

EXAMPLE 2

A 55 gallon metal drum of used crankcase oil was tested and found to contain 1800 ppm of chlorinated solvent (methylene chloride). A variable voltage source was provided and properly connected to the metal frame of the drum and to an end of electrode member 202. Reagent material provided in packets of dry chemicals, namely a dry chemical mixture consisting of (378 grams of calcium) and (378) grams of sodium hydroxide) and a packet of liquid chemical, namely (350) ml of ethyl alcohol) were added and mixed with the chlorinated solvent contents of the 55 gallon drum. A probe 200, constructed as previously described, in a closed position (ref. FIG. 8*a*) was inserted into the drum and utilized to further mix the solution. The voltage source was set to 12 volts and switched on to deliver the voltage to the electrode 202, probe 200 was then set to an open position (ref. FIG. 8) to allow migration of the chloride halogen. After 10 minutes of reaction time the voltage was turned off and the probe was again set to a closed position (ref. FIG. 8*a*). The probe containing the chloride halogen was removed from the drum and the non-hazardous halogen contents discarded. The contents of the chassis were retested and the concentration level of the methylene chloride was determined to be (320 ppm).

I claim:

1. An electrochemical process for dehalogenating halogenated hydrocarbon compounds, said process comprising:

(a) providing waste material contained in a container, said waste material comprising a halogenated hydrocarbon compound;

(b) providing a probe structure, said probe structure comprising a rigid, elongated, hollow, multi-piece tubular structure including an electrical insulating member, an electrode member and a hollow vessel portion;

(c) providing an electrical energy source for energizing said electrode member;

(d) determining that said halogenated hydrocarbon compound exceeds a toxic level of concentration;

(e) admixing to said contained halogenated hydrocarbon compound a predetermined amount of at least one metal hydroxide selected from a metallic hydroxide group consisting of sodium hydroxide, calcium hydroxide, and potassium hydroxide;

(f) further admixing an alcohol into the halogenated hydrocarbon compound/metal hydroxide mixture, said alcohol being selected from an alcohol group consisting of methanol, ethanol, or isopropanol;

(g) inserting said probe structure into said container;

(h) applying a voltage to said electrode member from said electrical energy source;

(i) producing an electrolyte salt solution containing metallic cations and halogen anions;

(j) migrating halogen anions towards said electrode member and into said hollow vessel portion of said probe structure;

(k) trapping said migrated halogen ions in said hollow vessel portion;

(l) stopping application of voltage and removing said probe structure containing trapped halogen from said container and disposing of said trapped halogen; and (m) repeating steps (d) through (l) as required until the concentration levels of halogen in the halogenated hydrocarbon compound is at, or below, a acceptable concentrations level.

2. The electrochemical process according to claim 1, wherein said step (e) also includes admixing at least one metal consisting of zinc, sodium, calcium and potassium, to assure an ample source of positively charged metal ions for combining with said halogen anions to form an electrolyte salt in solution.

3. An electrochemical process for dehalogenating halogenated hydrocarbon compounds, said process comprising:

(a) providing waste material contained in a metal container, said waste material comprising a halogenated hydrocarbon compound;

(b) providing a probe structure, said probe structure comprising a rigid, elongated, hollow, multi-piece tubular structure including an electrical insulating member, an electrode member and a hollow vessel portion;

(c) providing an electrical energy source for energizing said electrode member, said energy source having a positive lead connection and a negative lead connection;

(d) determining that said halogenated hydrocarbon compound exceeds a toxic level of concentration;

(e) admixing to said contained halogenated hydrocarbon compound a predetermined amount of at least one metal hydroxide selected from a metallic hydroxide group consisting of sodium hydroxide, calcium hydroxide, zinc hydroxide, and potassium hydroxide;

(f) further admixing an alcohol into the halogenated hydrocarbon compound/metal hydroxide mixture, said alcohol being selected from an alcohol group consisting of methanol, ethanol, or isopropanol;

(g) inserting said probe structure into said container;

(h) connecting said positive lead connection to said electrode member and connecting said negative lead connection to an external portion of said metal container;

(i) applying a voltage to said electrode member from said electrical energy source;

(j) producing an electrolyte salt solution containing metallic cations and halogen anions;

(k) migrating halogen anions towards said electrode member and into said hollow vessel portion of said probe structure;

(l) trapping said migrated halogen ions in said hollow vessel port ion;

(m) stopping application of voltage and disconnecting said connected positive and negative lead connection and removing said probe structure containing trapped halogen from said container and disposing of said trapped halogen; and (n) repeating steps (d) through (m) as required until the concentration levels of halogen in the halogenated hydrocarbon compound is at, or below, an acceptable concentrations level.

4. The electrochemical process according to claim 3, wherein said step (e) also includes admixing at least one metal consisting of zinc, sodium, calcium and potassium, to assure an ample source of positive charged metal ions for combining with said halogen anions to form an electrolyte salt in solution.

5. An electrochemical process for dehalogenating halogenated hydrocarbon compounds, said process comprising:

(a) providing waste material contained in a metal container, said waste material comprising a halogenated hydrocarbon compound;

(b) providing a probe structure, said probe structure comprising a rigid, elongated, hollow, multi-piece tubular structure including an electrical insulating member, an electrode member and a hollow vessel portion;

(c) providing an electrical energy source for energizing said electrode member, said energy source having a positive lead connection and a negative lead connection;

(d) determining that said halogenated hydrocarbon compound exceeds a toxic level of concentration;

(e) admixing to said contained halogenated hydrocarbon compound a predetermined amount of at least one metal consisting of zinc, sodium, calcium and potassium, to assure an ample source of positive charged metal ions for combining with said halogen anions to form an electrolyte salt in solution;

(f) further admixing an alcohol into the halogenated hydrocarbon compound/metal mixture, said alcohol being selected from an alcohol group consisting of methanol, ethanol, or isopropanol;

(g) inserting said probe structure into said container;

(h) connecting said positive lead connection to said electrode member and connecting said negative lead connection to an external portion of said metal container;

(i) applying a voltage to said electrode member from said electrical energy source;

(j) producing an electrolyte salt solution containing metallic cations and halogen anions;

(k) migrating halogen anions towards said electrode member and into said hollow vessel portion of said probe structure;

(l) trapping said migrated halogen ions in said hollow vessel portion;

(m) stopping application of voltage and disconnecting said connected positive and negative lead connection and removing said probe structure containing trapped halogen from said container and disposing of said trapped halogen; and (n) repeating steps (d) through (m) as required until the concentration levels of halogen in the halogenated hydrocarbon compound is at, or below, an acceptable concentrations level.

6. An electrochemical process for dehalogenating a halogenated hydrocarbon compound, said process comprising:

(a) providing a probe structure, said probe structure comprising a rigid, elongated, hollow, multi-piece tubular structure including an electrical insulating member, an electrode member and a hollow vessel portion;

(b) providing an electrical energy source for energizing said electrode member;

(c) reacting said halogenated hydrocarbon compound with at least one metal hydroxide selected from a metallic hydroxide group consisting of sodium hydroxide, calcium hydroxide, zinc hydroxide, and potassium hydroxide in the presence of an alcohol selected from an alcohol group consisting of methanol, ethanol, or isopropanol;

(d) inserting said probe structure into said container;

(e) applying a voltage to said electrode member from said electrical energy source;

(f) producing an electrolyte salt solution containing metallic cations and halogen anions;

(g) migrating halogen anions towards said electrode member and into said hollow vessel portion of said probe structure;

(h) trapping said migrated halogen ions in said hollow vessel portion; and (i) stopping application of voltage and removing said probe structure containing trapped halogen from said container and disposing of said trapped halogen.

7. An electrochemical process for dehalogenating a halogenated hydrocarbon compound, said process comprising:

(a) providing a probe structure, said probe structure comprising a rigid, elongated, hollow, multi-piece tubular structure including an electrical insulating member, an electrode member and a hollow vessel portion;

(b) providing an electrical energy source for energizing said electrode member;

(c) reacting said halogenated hydrocarbon compound with at least one metal consisting of zinc, sodium, calcium and potassium, in the presence of an alcohol selected from an alcohol group consisting of methanol, ethanol, or isopropanol;

(d) inserting said probe structure into said container;

(e) applying a voltage to said electrode member from said electrical energy source;

(f) producing an electrolyte salt solution containing metallic cations and halogen anions;

(g) migrating halogen anions towards said electrode member and into said hollow vessel portion of said probe structure;

(h) trapping said migrated halogen ions in said hollow vessel portion; and (i) stopping application of voltage and removing said probe structure containing trapped halogen from said container and disposing of said trapped halogen.

* * * * *